US010710753B2

(12) United States Patent
Tamarindo

(10) Patent No.: US 10,710,753 B2
(45) Date of Patent: Jul. 14, 2020

(54) METHOD FOR FILLING A THIN-BODY FLEXIBLE BAG PROVIDED WITH A SPOUT

(71) Applicant: GUALA PACK S.p.A., Castellazzo Bormida (IT)

(72) Inventor: Stefano Tamarindo, Castellazzo Bormida (IT)

(73) Assignee: GUALA PACK S.P.A., Castellazzo Bormida (IT)

( * ) Notice: Subject to any disclaimer, the term of this patent is extended or adjusted under 35 U.S.C. 154(b) by 0 days.

(21) Appl. No.: 16/168,207

(22) Filed: Oct. 23, 2018

(65) Prior Publication Data

US 2019/0119024 A1 Apr. 25, 2019

(30) Foreign Application Priority Data

Oct. 24, 2017 (IT) ..... 102017000120600

(51) Int. Cl.

| | |
|---|---|
| ***B65B 3/17*** | (2006.01) |
| ***B65D 77/06*** | (2006.01) |
| ***B65B 61/18*** | (2006.01) |
| ***B65D 75/58*** | (2006.01) |
| ***B65B 3/10*** | (2006.01) |
| ***B65B 39/00*** | (2006.01) |
| ***B65B 3/04*** | (2006.01) |
| *B65D 83/00* | (2006.01) |
| *B65D 47/20* | (2006.01) |

(52) U.S. Cl.

CPC ..... *B65B 3/17* (2013.01); *B65B 3/045* (2013.01); *B65B 3/10* (2013.01); *B65B 39/004* (2013.01); *B65B 61/186* (2013.01); *B65D 75/5866* (2013.01); *B65D 77/065* (2013.01); *B65D 47/2031* (2013.01); *B65D 75/5883* (2013.01); *B65D 83/0055* (2013.01)

(58) Field of Classification Search

CPC ..... B65B 3/045; B65B 3/17; B65D 2575/586; B65D 2575/583; A61J 9/005; A61J 11/002

See application file for complete search history.

(56) References Cited

U.S. PATENT DOCUMENTS

| | | | | |
|---|---|---|---|---|
| 5,409,144 | A | 4/1995 | Brown | |
| 5,975,163 | A | 11/1999 | Angeli | |
| 9,918,580 | B2 * | 3/2018 | Jan | A47J 47/01 |
| 2008/0105328 | A1 * | 5/2008 | Desmond | A45C 3/00 141/2 |
| 2013/0074456 | A1 * | 3/2013 | Hradisky | B65B 39/06 53/473 |
| 2015/0014369 | A1 | 1/2015 | Hatton et al. | |
| 2017/0088318 | A1 | 3/2017 | Franca et al. | |

FOREIGN PATENT DOCUMENTS

| | | |
|---|---|---|
| EP | 1731426 A1 | 12/2006 |
| EP | 2241501 | 10/2010 |

OTHER PUBLICATIONS

Search Report and Written Opinion for Italian Application 10201700120600 dated May 7, 2018.

* cited by examiner

*Primary Examiner* — Timothy P. Kelly

(74) *Attorney, Agent, or Firm* — Thomas|Horstemeyer, LLP

(57) ABSTRACT

The invention relates to a method for filling a thin-body flexible package provided with a spout. The spout is provided with a normally closed membrane valve. The filling system provides a filling nozzle which dispenses the product intended to fill the bag upstream of the valve, outside the spout or inside it.

5 Claims, 7 Drawing Sheets

METHOD FOR FILLING A THIN-BODY FLEXIBLE BAG PROVIDED WITH A SPOUT

CROSS-REFERENCE TO RELATED APPLICATION

This application claims priority to and benefit of Italian Patent Application having Ser. No. 102017000120600, filed Oct. 24, 2017, which is entirely incorporated herein by reference.

SUMMARY

The present invention relates to the field of flexible bags with a spout, usually called "spouted pouches", and in particular to the field of methods of filling the flexible bags with liquid or semi-dense products, for example fruit juices, yoghurt, fruit purée and the like.

Flexible bags with spout have recently become widespread, due to the practicality of use thereof, which makes them an article particularly appreciated for children, the versatility of use for the containment of products with very different physical-chemical features and the very low cost.

To date, it is estimated that the worldwide production of flexible bags with spout is a few hundred million pieces per year.

Therefore, the filling lines of the packaging must be particularly efficient to ensure high production volumes, and reliable, to avoid production stops.

One of the most felt needs in the field of flexible bags with spout is to have a spout that can prevent the accidental leakage of the product, especially since they are widely consumed among children.

For this reason, spouts have been designed provided with valve systems capable of preventing or limiting the accidental leakage of the product (no-spill systems). An example of embodiment is described in document WO 2015/145277 by the Applicant. A further example of embodiment is described in document WO 00/30969.

Obviously, the filling of a flexible bag with spout, the spout whereof has a no-spill system inside, poses some problems. For example, the no-spill system could negatively affect filling times and therefore production volumes.

The object of the present invention is to provide a method for filling a flexible bag with a spout provided with a no-spill system which is particularly effective and reliable.

Such an object is achieved by a filling method according to claim 1. The dependent claims describe further advantageous embodiments of the invention.

BRIEF DESCRIPTION OF THE DRAWINGS

The features and the advantages of the filling method according to the present invention will appear more clearly from the following description, made by way of an indicative and non-limiting example with reference to the accompanying figures, in which.

DETAILED DESCRIPTION

Figure 1:
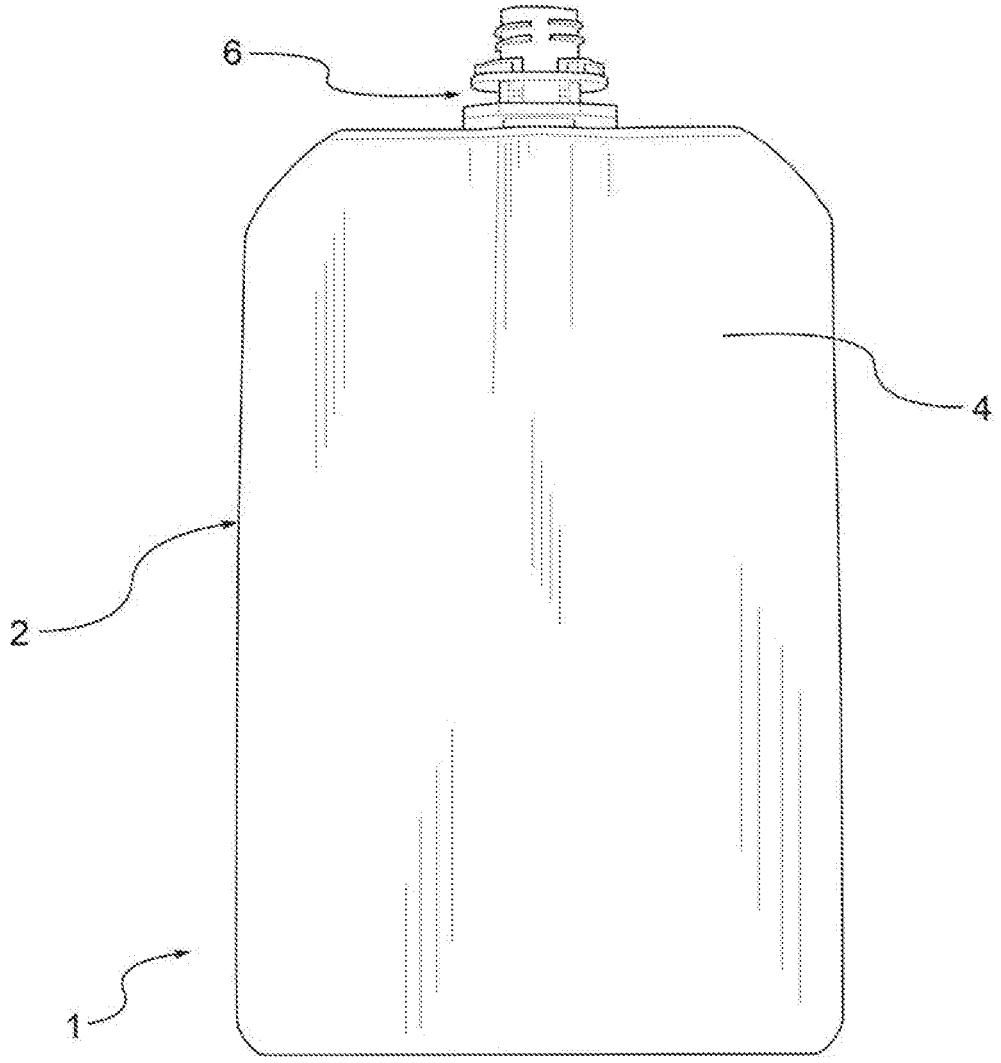
FIG. 1 shows a thin-body flexible bag provided with a spout.
Figure 2A:
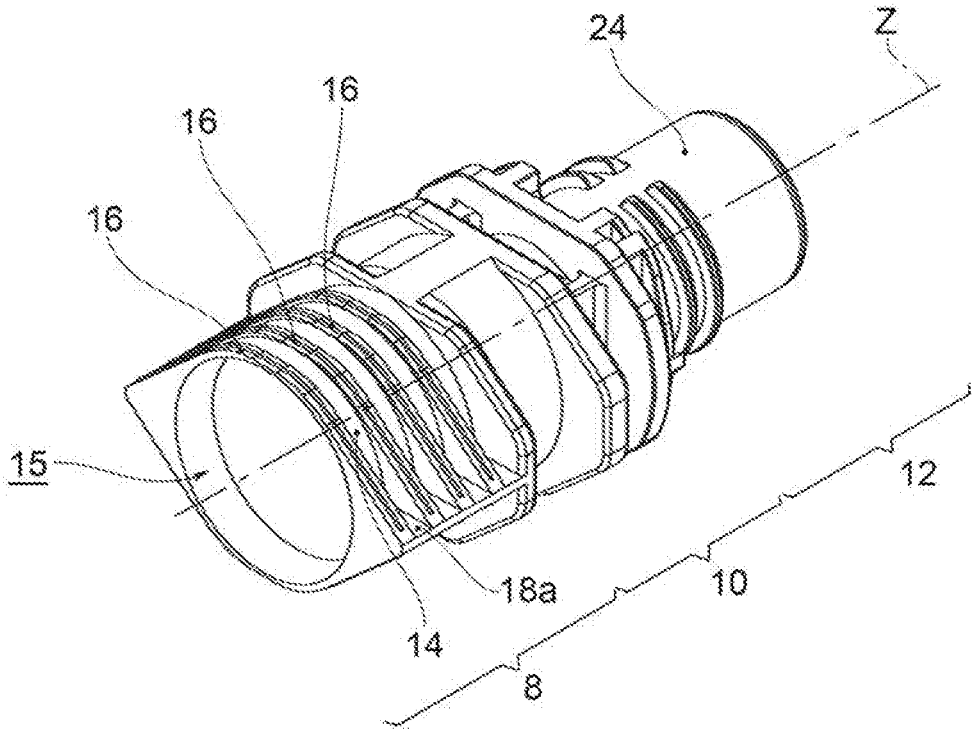
FIGS. 2*a* and 2*b* show the spout of the bag in FIG. 1.
Figure 2B:
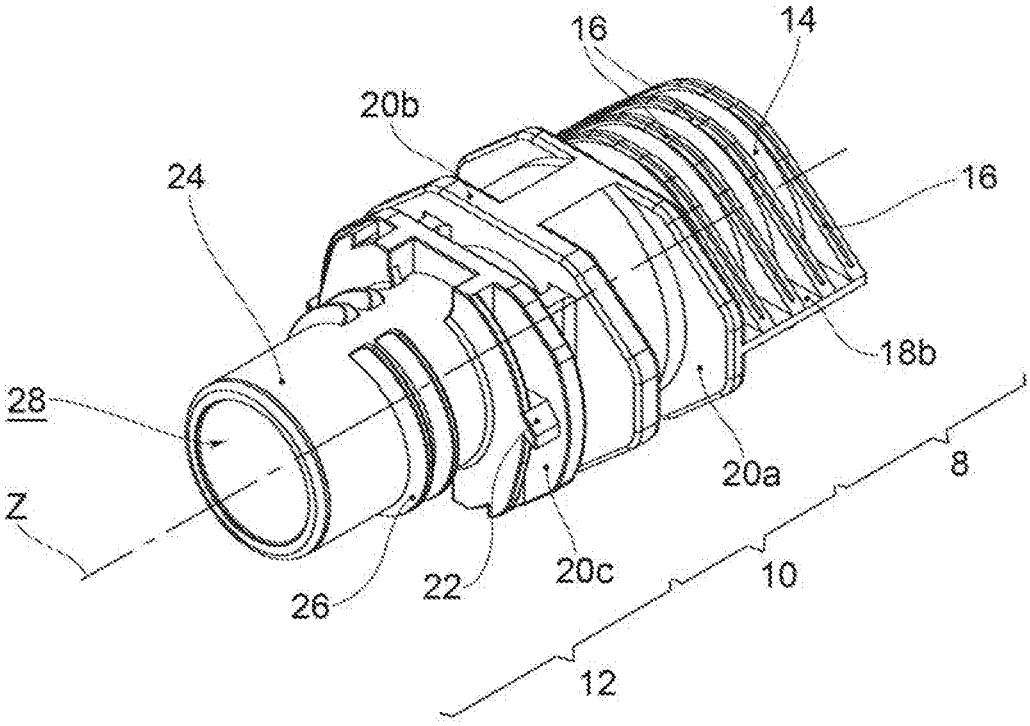
Figure 3:
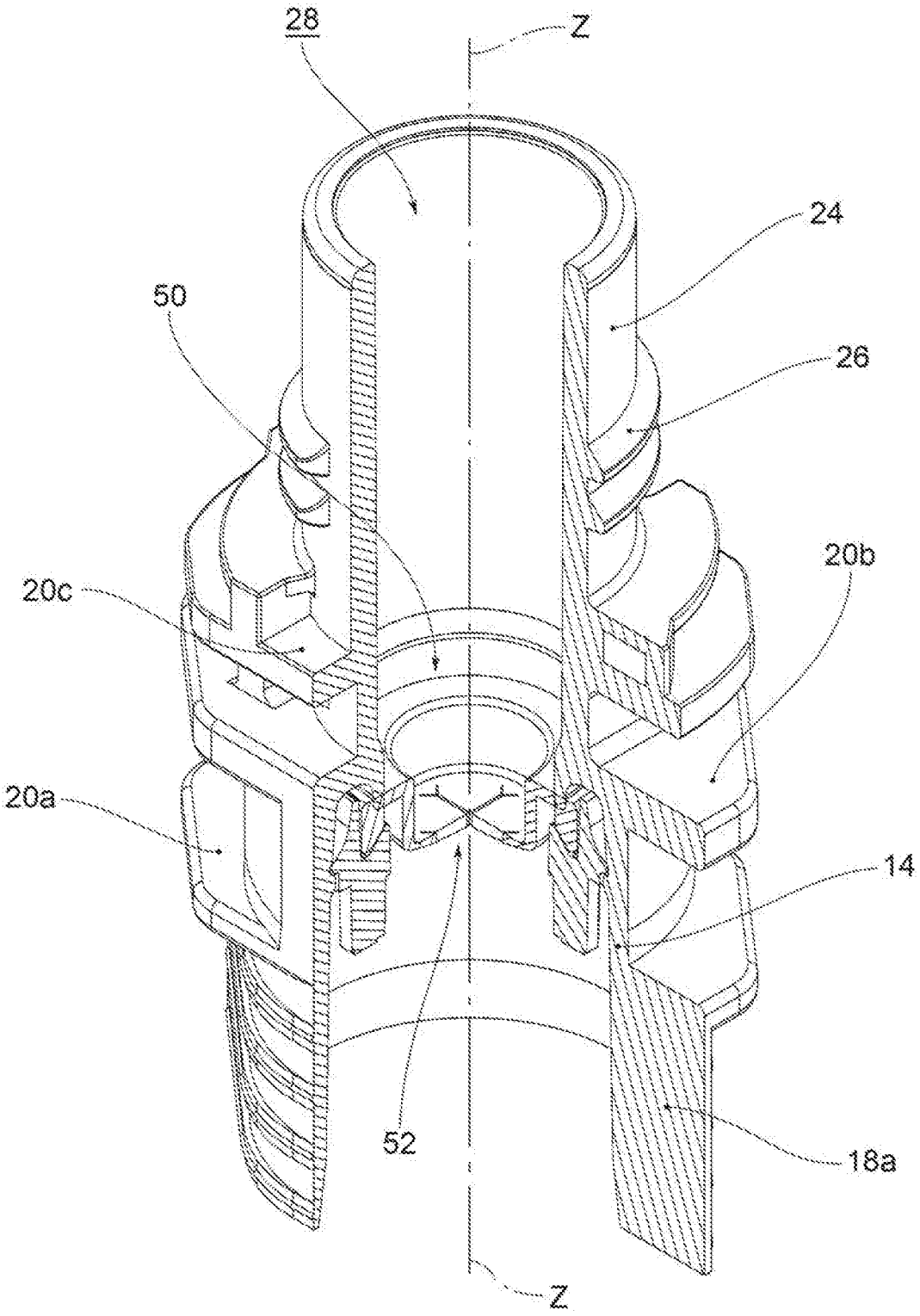
FIG. 3 shows a partially sectional view of the spout shown in FIGS. 2*a* and 2*b;*
Figure 4:
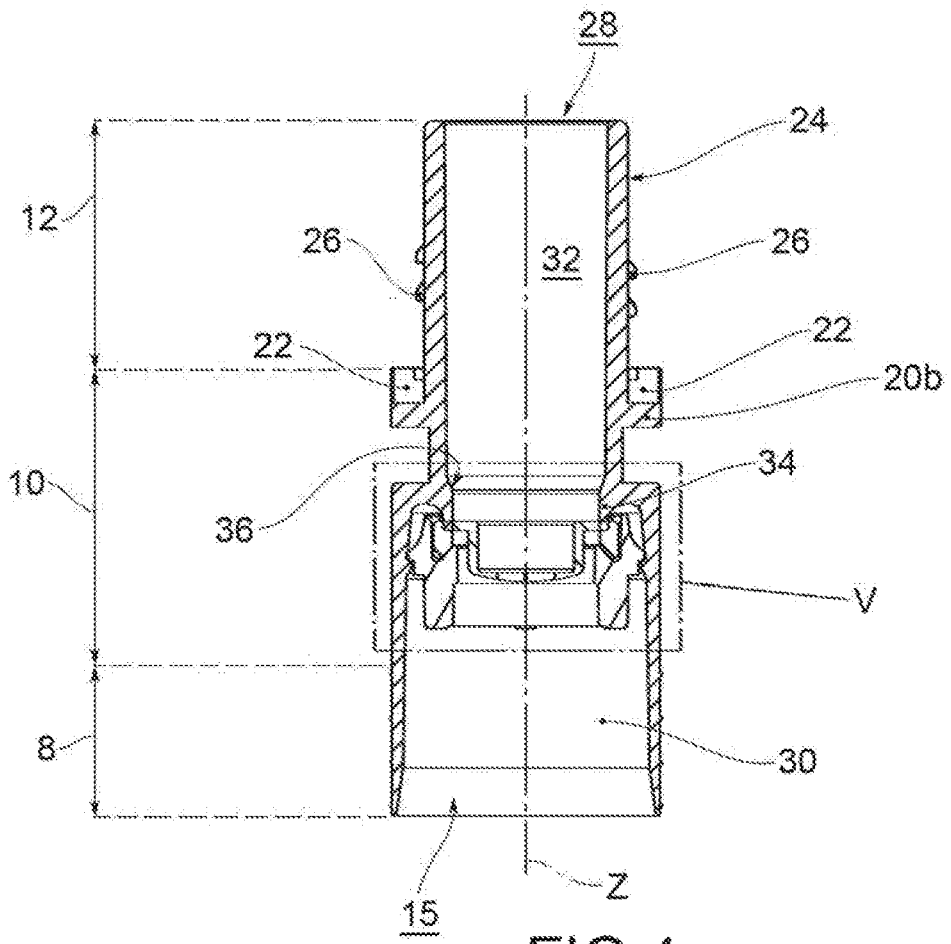
FIG. 4 shows a plan sectional view of the spout of the preceding figures.
Figure 5:
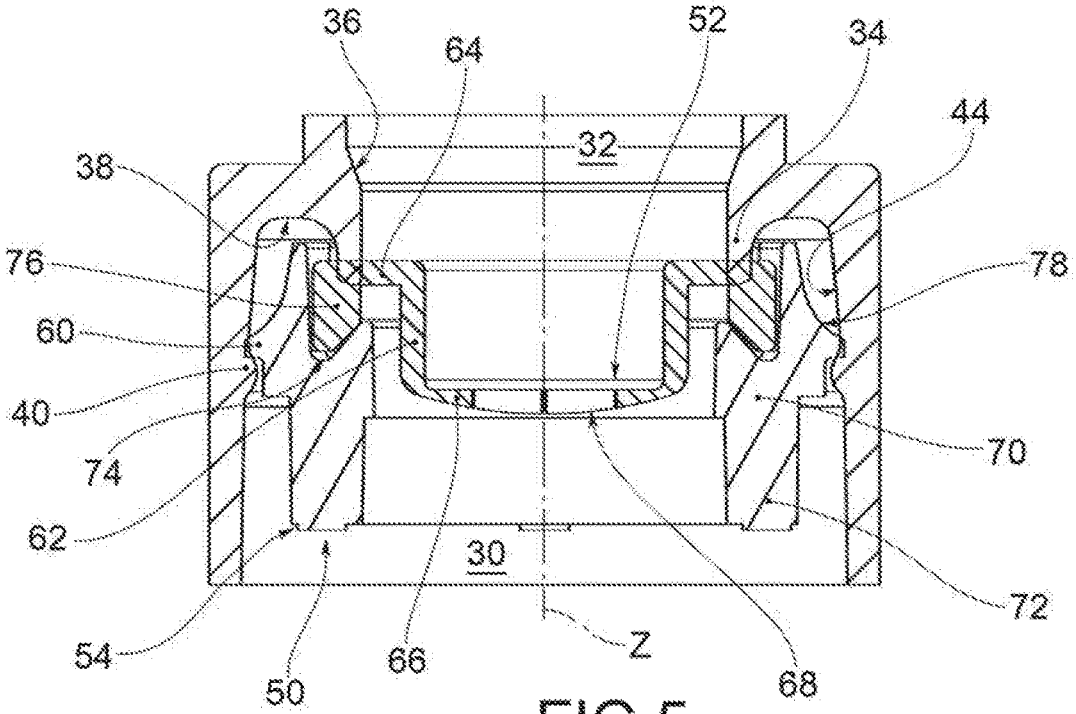
FIG. 5 shows an enlargement of region V in FIG. 4.
Figure 6:
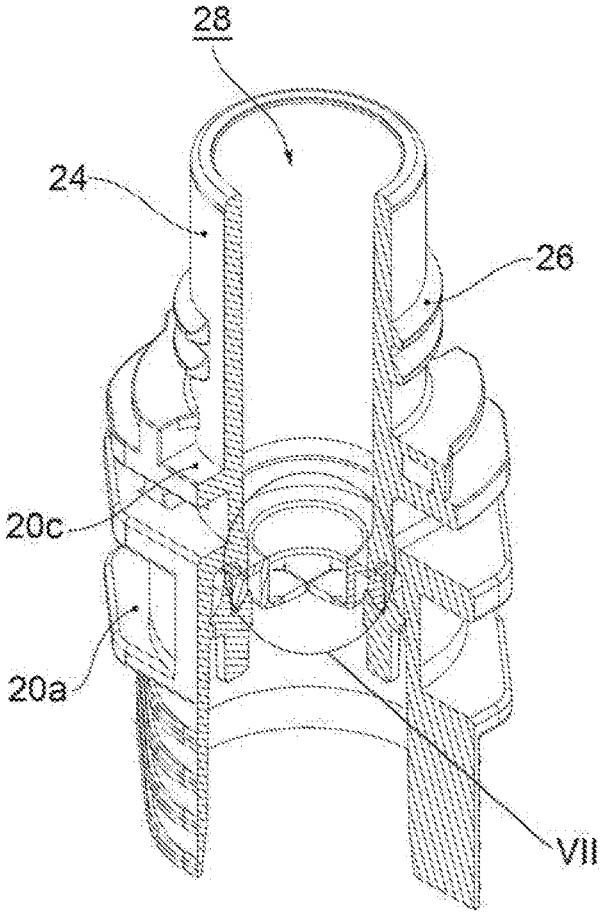
FIG. 6 shows the spout of the preceding figures, partially sectional, in a configuration of closing a valve.
Figure 8:
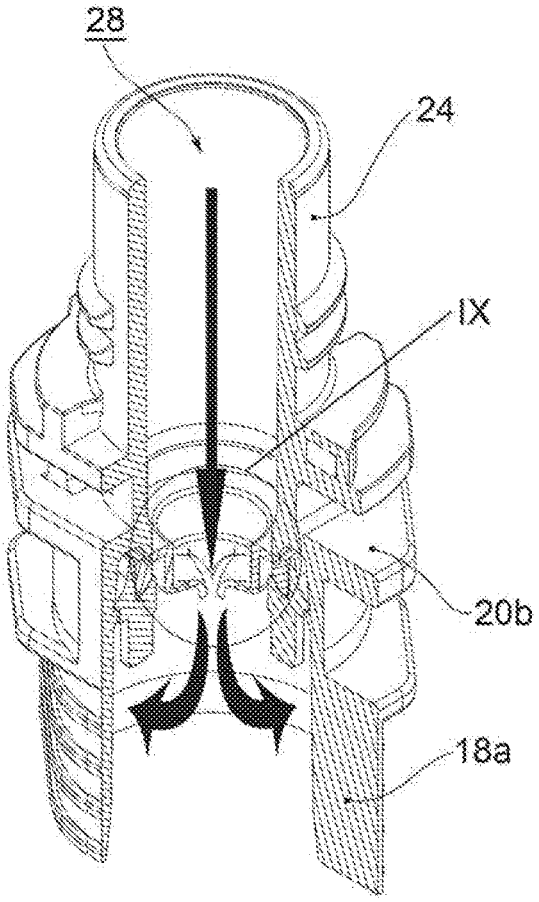
FIG. 8 shows the spout in FIG. 6, in a configuration of opening the valve.

With reference to the accompanying drawings, reference numeral 1 indicates a flexible pouch, comprising a bag 2 formed by two or more walls 4 made of flexible film, facing and joined, for example welded, along the edges, possibly with gusset side walls (gusset pouch) or with a back wall.

The pouch 1 comprises a spout 6 (spouted pouch) of rigid material, sealingly applied to the bag 2. In particular, the spout 6 is typically inserted in a portion of the edge of the bag 2, usually between the side walls 4.

Preferably, the spout 6 is made as a single piece, internally hollow, of plastic material, for example of polyethylene or polypropylene, by injection molding.

The spout 6 develops substantially along a longitudinal axis Z and provides externally, in succession, a welding portion 8, an intermediate portion 10 and an end portion 12.

The welding portion 8 comprises an annular base wall 14, usually internally cylindrical and externally circular, having an inner opening 15, and a plurality of ribs 16 protruding from the outer surface of the base wall 14, arranged parallel to each other, in axial succession.

Moreover, the welding portion 8 comprises a pair of flat side tabs 18*a*, 18*b*, projecting radially outwardly from the base wall 14, arranged diametrically opposite and coplanar on an imaginary plane which contains the longitudinal axis Z.

The ribs 16 are arranged on one side and on the other of the imaginary plane, extending over the base wall 14 and up to the end of the side tabs 18*a*, 18*b*, forming a typical "boat" structure, so much so that the welding portion is often referred to as a "welding boat".

The intermediate portion 10 preferably comprises a plurality of transverse plates 20*a*, 20*b*, 20*c*, for example in a number of three, lying on imaginary planes orthogonal to the longitudinal axis Z, axially spaced apart from each other.

The plate 20*c* closest to the end portion 12 preferably carries a plurality of engagement elements 22 for engaging with a guarantee seal of a spout cap.

The end portion 12 typically has a thread 26 and a free outer surface 24.

Internally, the spout 6 is provided with at least two compartments: an inner chamber 30, accessible through the inner opening 15, and a main duct 32, accessible through the mouth portion 28 and adjacent to the inner chamber 30.

Preferably, the inner chamber 30 extends axially starting from the inner opening 15 for the whole welding portion 8 and for a part of the intermediate portion 10; the main duct 32 extends axially starting from the mouth portion 28 for the whole end portion 12 and for the remaining part of the intermediate portion 10.

In particular, the main duct 32 leads into the inner chamber 30 through a tubular tang wall 34.

Preferably, the tang wall 34 has a cylindrical circular inner side surface and a diameter smaller than the diameter of the main duct 32.

The connection between the inner side surface of the tang wall 34 and the surface of the main duct 32 is obtained from a frustoconical connecting surface 36.

On the side of the inner chamber 30, the tang wall 34 is surrounded by an annular recess 38.

Moreover, at a predefined axial distance from the free end of the tang wall 34, the inner chamber 30 has a circumferential projection 40, continuous or in segments, and preferably a connecting surface 44 of the inner chamber 30, between the circumferential projection 40 and the recess 38, is frustoconical, converging towards the recess.

According to the invention, a valve assembly 50 is provided inside the spout 6, in the inner chamber 30, at the tang wall 34.

The valve assembly 50 comprises a valve 52, made as a single piece, preferably made of silicone, and a retaining ring 54, made as a single piece, made of plastic material, for supporting and applying the valve 52.

The valve 52 comprises an annular outer wall 60, an annular inner wall 62, radially arranged inside the outer wall 60, an intermediate wall 64, substantially lying on a plane orthogonal to the longitudinal axis Z, and a flexible membrane 66 which closes the inner wall 62.

Figure 7:
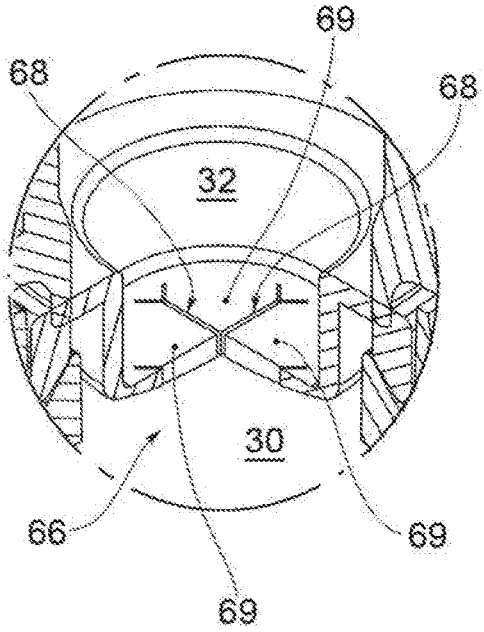
FIG. 7 shows an enlargement of region VII in FIG. 6.
Figure 9:
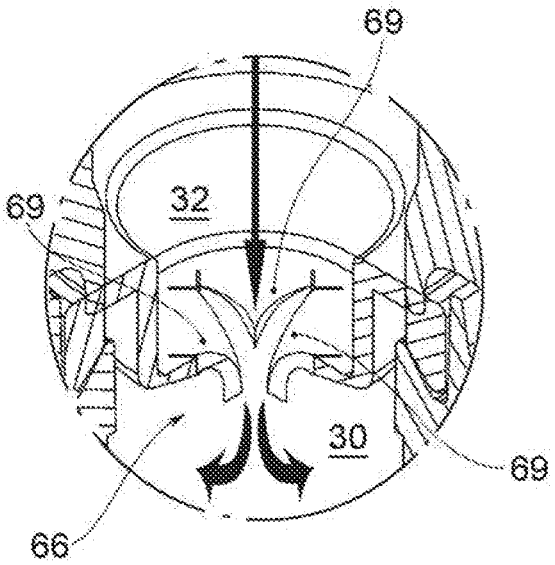
FIG. 9 shows an enlargement of region IX in FIG. 8.

The membrane 66 has at least one cut 68, preferably a plurality of through cuts 68 which form membrane flaps 69, normally closed (FIG. 7).

The valve 52 is placed abutting against the tang wall 34; in particular, the outer wall 60 is at the tang wall 34.

Overall, the valve 52 has a concave profile on the side of the main duct 32.

In particular, the membrane 66 is flat or concave on the side facing the main duct, while preferably it has a convex profile towards the inner chamber 30.

The retaining ring 54 comprises a support portion 70, which supports the valve 52, and a tail portion 72.

The support portion 70 has internally an annular seat 74, in which the outer wall 60 of the valve 52 is inserted, and externally a radial projection 76 for the snap engagement with the circumferential projection 40 of the inner chamber 30.

In front of the radial projection 76, the support portion 70 has a concave support surface 78 to facilitate the snap engagement with the circumferential projection 40.

The axial dimensions of the valve assembly are such that the valve assembly 50 is arranged in the inner chamber 30, but outside the portion of the inner chamber 30 corresponding to the welding portion 8.

Advantageously, this allows preventing structural deformations of the valve or of the retaining ring or of both, due to the heat and to the mechanical actions that develop during the welding process of the spout to the bag.

For the assembly of the spout 6 and the valve assembly 50, the latter is inserted into the spout 6 on the side of the inner opening 15 and the valve 52 is brought in abutment with the tang wall 34.

By axially forcing the retaining ring 54, a snap engagement with the spout is implemented, and in particular between the radial projection 76 of the retaining ring 54 and the circumferential projection 40 of the inner chamber.

The valve 52, and in particular the outer wall 60, remains pinched between the tang wall 34 and the support portion 70 of the retaining ring.

Once the spout 6 is applied to the bag 2, the bag is filled through the mouth portion 28 of the main duct 32 (FIGS. 6 to 9).

In particular, the filling is carried out by means of a filling nozzle, from which the product to be filled comes out, which for the entire filling step of the bag remains outside the spout.

In the prior art filling procedures, a cannula is provided which is inserted into the main duct, passes through the valve membrane, thus spreading the flaps and feeds the product directly into the bag or into the inner chamber of the spout.

Contrary to what happens in the prior art processes, the present invention provides for positioning the filling nozzle outside the spout and letting the product out of it.

The product flows into the main duct and comes into contact with the membrane 66 of the valve 52, operating an action from the outside on the latter, such as to deform the flaps 69 inwardly, so as to enter the inner chamber 30.

In other words, the membrane 66 of the valve 52 provides flaps 69 having to sufficient flexibility to be deformed inwardly by the action of the product fed into the main duct.

Figure 10:
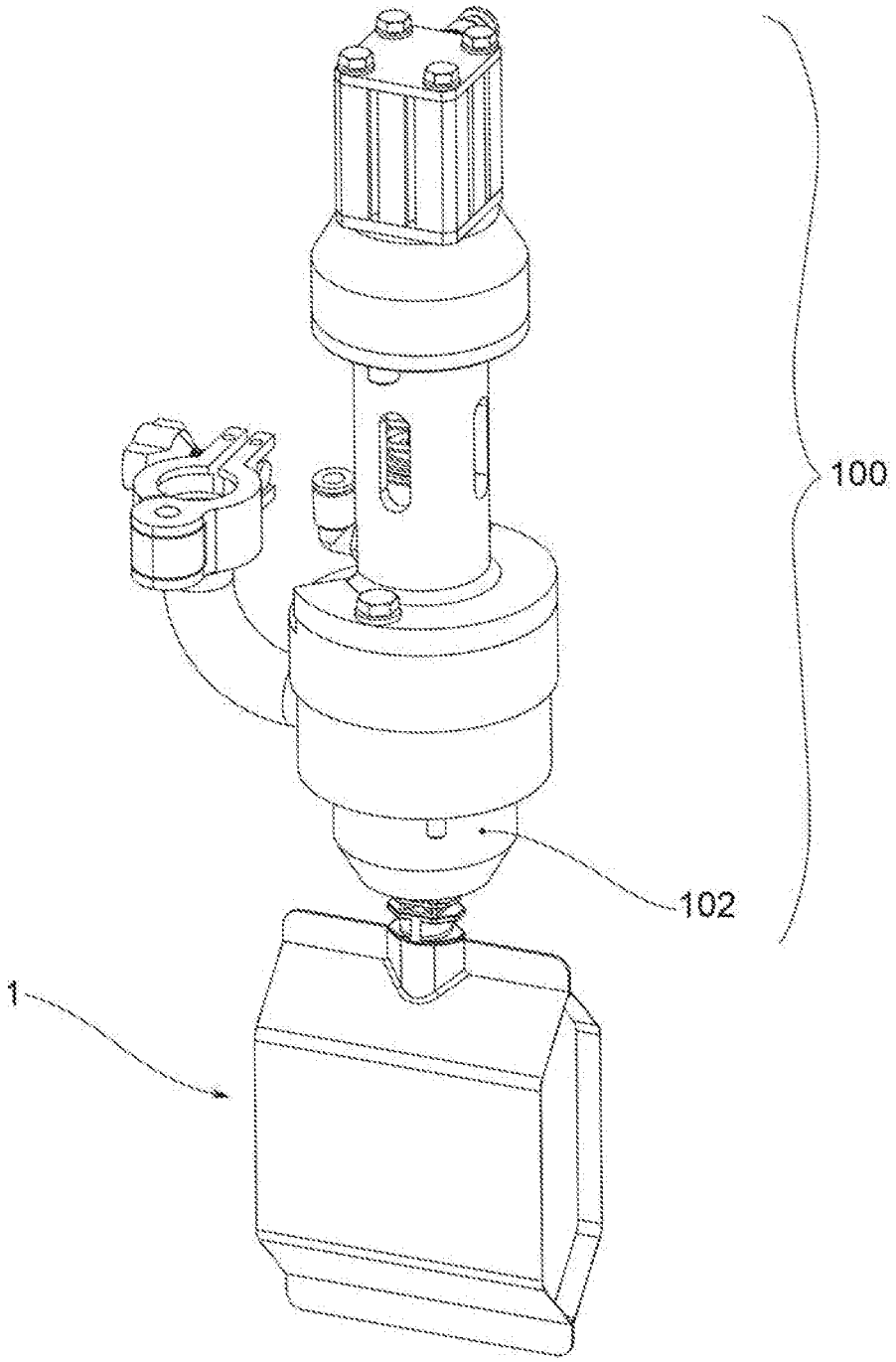
FIGS. 10 and 11 schematically show a filling nozzle and a flexible bag to be filled according to an embodiment of the present invention.
Figure 11:
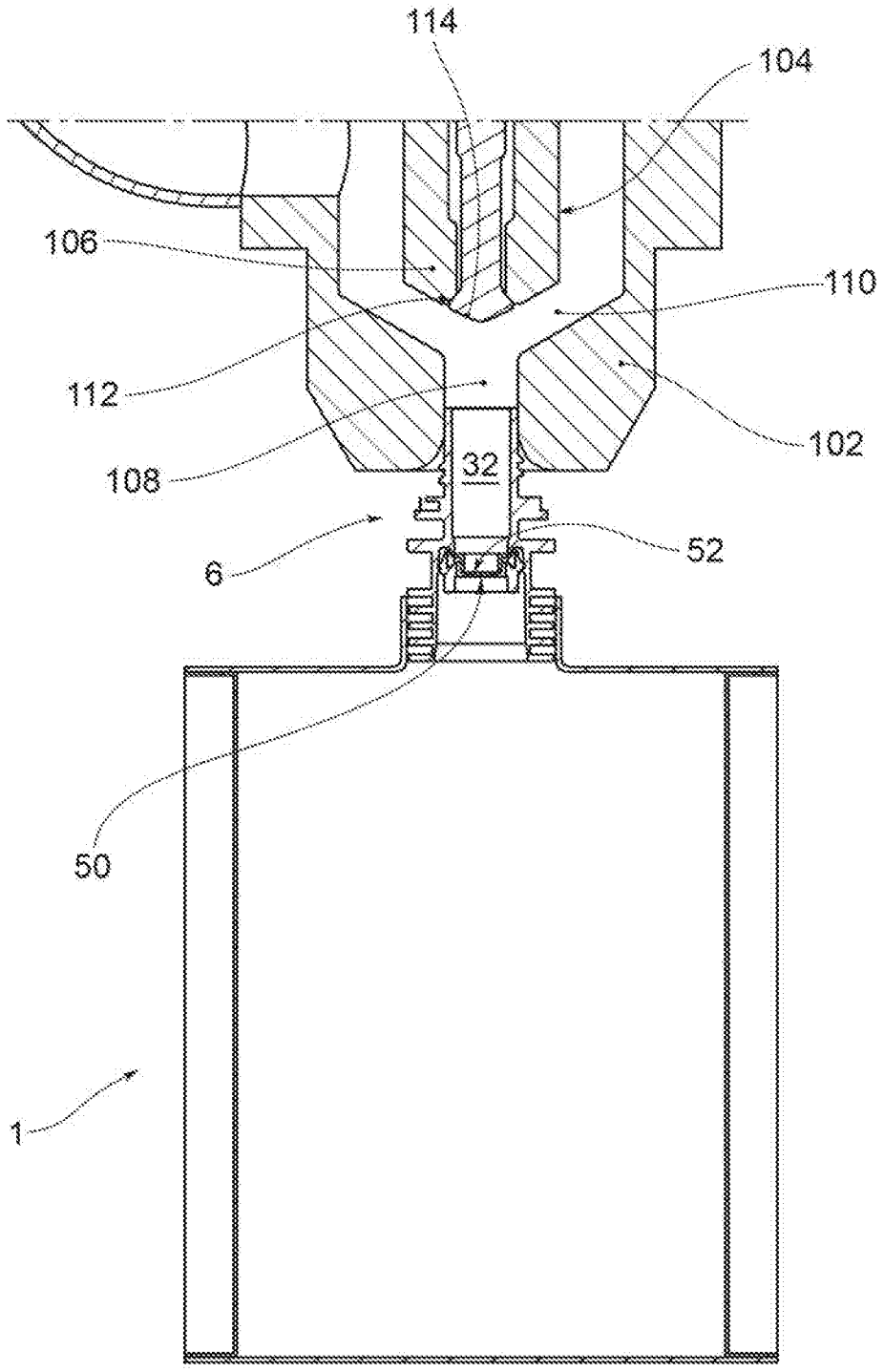

According to a preferred embodiment, a filling machine for filling the bags with a spout described above comprises a plurality of nozzle groups 100 (FIGS. 10 and 11), comprising a gripping body 102, which engages with the spout 6, and a nozzle 104 for dispensing the product, provided with a dispensing end 106 located inside the gripping body 102.

In particular, the gripping body 102 is provided with a straight gripping conduit 108, in which the end portion 12 of the spout 6 is partially inserted, and in particular the portion thereof corresponding to the free outer surface 24.

The gripping body 102 then internally has a collection compartment 110, which feeds the gripping conduit 108 and which houses the dispensing end 106 of the nozzle 104.

The dispensing end 106 has a delivery port 112, normally closed, for example by a shutter 114, preferably in the form of a stem.

From the delivery port 112, arranged upstream of the mouth portion 28, the product for filling comes out.

The shutter 114 can be controlled so as to open and close the delivery port 112.

When the shutter 114 opens the delivery port 112, the product flows into the collection compartment 110, then into the gripping conduit 108 and, through the mouth portion 28, into the main conduit 32 of the spout 6 and, when the valve 52 is opened, inside of the bag 2.

Innovatively, the filling method according to the present invention meets the needs of the industry, since it is particularly reliable, does not provide complex injection cannulas and therefore does not put the integrity of the valve at risk, which could be damaged by insertion of the cannula according to the prior art.

It is clear that a man skilled in the art can make changes to the filling method described above.

For example, according to a variant embodiment, the nozzle partially penetrates into the main duct of the spout, so that the delivery port 112 is located in the main duct 32, upstream of the valve 52, without passing therethrough.

Also such variants are included within the scope as defined by the following claims.

What is claimed is:

1. A method for filling a thin-body flexible package provided with a spout, comprising the steps of:

providing for, inside the spout, a main duct accessible by a mouth portion and an inner chamber adjacent to the main duct and accessible by an inner opening opposite the mouth portion;

providing for a valve assembly comprising a normally closed valve made as a single piece and a retaining ring made as a single piece, where the normally closed valve comprises a flexible membrane provided with at least one through-cut forming flaps of the membrane, the normally closed valve being arranged between the main duct and the inner chamber of the spout;

providing for a filling nozzle provided with a dispensing opening arranged upstream of the valve for dispensing a product intended to fill the package;

causing the product to flow from the filling nozzle into the main duct;

deforming the flaps so as to open the valve by the action of the product in the main duct;

causing the product to flow into the inner chamber through an opening made by the flaps deformed by the product.

2. The filling method according to claim 1, wherein:

the package comprises a pouch comprising walls formed of flexible film;

the spout externally comprises a weld portion having a predetermined axial extension, the weld portion being welded between the walls of the pouch;

the valve is arranged inside the spout, in an area outside the weld portion.

3. The filling method according to claim 1, wherein the membrane of the valve is flat or concave on the side facing the main duct.

4. The filling method according to claim 1, wherein the dispensing opening is positioned upstream of the mouth portion.

5. The filling method according to claim 1, wherein the dispensing opening is positioned in the main duct upstream of the valve.

* * * * *